US008346142B2

(12) United States Patent
Kodama

(10) Patent No.: US 8,346,142 B2
(45) Date of Patent: Jan. 1, 2013

(54) IMAGE FORMING APPARATUS CONFIGURED TO EJECT AIR TOWARD A GAP BETWEEN THE TOP END OF A SHEET HAVING PASSED THROUGH A NIP PORTION AND THE CIRCUMFERENCE OF A FIXING ROTATING MEMBER OF THE NIP PORTION

(75) Inventor: Hirokazu Kodama, Ryugasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 214 days.

(21) Appl. No.: 12/778,450

(22) Filed: May 12, 2010

(65) Prior Publication Data

US 2010/0303522 A1 Dec. 2, 2010

(30) Foreign Application Priority Data

May 26, 2009 (JP) ..... 2009-126322

(51) Int. Cl.
*G03G 15/20* (2006.01)

(52) U.S. Cl. ..... 399/323

(58) Field of Classification Search ..... 399/323
See application file for complete search history.

(56) References Cited

U.S. PATENT DOCUMENTS

| | | | | |
|---|---|---|---|---|
| 5,406,363 | A * | 4/1995 | Siegel et al. | 399/323 |
| 2007/0147912 | A1 * | 6/2007 | Fujii | 399/323 |
| 2009/0279928 | A1 * | 11/2009 | Ishikawa | 399/323 |
| 2009/0304419 | A1 * | 12/2009 | Roof et al. | 399/323 |

FOREIGN PATENT DOCUMENTS

JP 2005-157179 6/2005

* cited by examiner

*Primary Examiner* — David Gray
*Assistant Examiner* — Laura Roth
(74) *Attorney, Agent, or Firm* — Fitzpatrick, Cella, Harper & Scinto

(57) ABSTRACT

An image forming apparatus includes an air ejecting portion that ejects air toward a gap between the top end of a sheet having passed through a nip of the heating roller and a pressure roller, and the circumference of the heating roller. The air ejecting portion includes a plurality of air nozzles and a plurality of electromagnetic valves being respectively connected thereto and ejects air selectively from a plurality of air ejection positions arranged in the width direction perpendicular to the sheet conveying direction.

11 Claims, 14 Drawing Sheets

IMAGE FORMING APPARATUS CONFIGURED TO EJECT AIR TOWARD A GAP BETWEEN THE TOP END OF A SHEET HAVING PASSED THROUGH A NIP PORTION AND THE CIRCUMFERENCE OF A FIXING ROTATING MEMBER OF THE NIP PORTION

BACKGROUND OF THE INVENTION

1. Field of the Invention

The present invention relates to an image forming apparatus such as a printer, a copying machine and a facsimile machine which performs image forming with an electrographic system, and in particular, related to an image forming apparatus to peel a sheet from a fixing portion by ejecting compressed air toward a sheet top end after fixing.

2. Description of the Related Art

In general, an image forming apparatus to form an image with the electrographic system is provided with a fixing apparatus as a fixing portion including a heat roller as a fixing rotating member with a heat source and a pressure roller as a pressing rotating member to be pressure-contacted to the heat roller. A sheet having a non-fixed toner image formed is conveyed to a nip portion of the heat roller and the pressure roller. Then, the fixing apparatus melts non-fixed toner by applying heat and pressure to the sheet which passes through the nip portion, so that the toner image is fixed on the sheet.

When a toner image is fixed by applying heat and pressure to a sheet, although rare but there has been a case that the sheet is twisted around the heat roller due to melted toner. In order to solve this problem, a fixing apparatus as described above has been provided with a separation claw contacted to the heat roller. With the separation claw, the sheet is easily peeled from the heat roller when image density is low or when distance from a sheet edge to an image (hereinafter called white space) is spaced.

However, with a small grammage sheet (particularly, coated paper), for example, sticking force of melted toner to the heat roller becomes large in the case of high density color image or less white space image, so that the separation claw is hard to enter between the sheet and the heat roller. Accordingly, there has been a case that the separation claw hurts the edge of the sheet. Further, since the separation claw is contacted to the melted toner image, there has been a problem that the toner image is apt to be damaged. Furthermore, since the separation claw is contacted to the heat roller, there has been a case that the heat roller is scratched and poor imaging occurs due to transfer of the scratch to the melted toner.

As a separation method without damaging an image to be fixed on a sheet and the heat roller, a separation method having a nozzle which is arranged between the heat roller and a peeling guide plate arranged at the vicinity thereof and ejecting compressed air from the nozzle has been proposed. With this separation method, the sheet top end stuck to the heat roller is separated from the heat roller by ejecting compressed air and the entire sheet is peeled from the heat roller by the peeling guide plate thereafter.

With the separation method utilizing compressed air, pulse-like compressed air is blown to a surface of the heat roller from the nozzle which is constituted with a pipe-shaped introduction path and an ejection port arranged at the top end thereof. Accordingly, when the compressed air ejected from the nozzle is ejected to a part of the heat roller several times, there has been a case that surface temperature of the heat roller is decreased in part. When the surface temperature of the heat roller is decreased, there has been a case that poor imaging such as gloss unevenness and poor fixing is caused on a fixed image to be obtained.

Accordingly, there has been a proposal to prevent poor imaging by increasing temperature of ejection air while heating the compressed air to be ejected to prevent temperature decrease of the heat roller (see Japanese Patent Application Laid-Open No. 2005-157179).

However, with the abovementioned method to heat compressed air, a heater for heating air is required and power is consumed to operate the heater. Therefore, there has been a problem of cost increase.

The present invention provides an image forming apparatus capable of preventing poor imaging caused by temperature decrease of a fixing rotating member due to ejected air and capable of reducing cost and power consumption.

According to the invention, an image forming apparatus includes:

- a transfer portion which transfers a toner image to a sheet;
- a fixing portion which includes a fixing rotating member having a heat source and a pressing rotating member being pressure-contacted to the fixing rotating member and which fixes the toner image on the sheet at a nip portion of the fixing rotating member and the pressing rotating member; and
- an air ejecting portion which is capable of ejecting air toward a gap between the top end of the sheet having passed through the nip portion and the circumference of the fixing rotating member and which includes a plurality of air ejection positions arranged in the width direction being perpendicular to a sheet conveying direction;
- wherein a control portion controls the air ejecting portion so as to selectively eject air.

SUMMARY OF THE INVENTION

According to the present invention, temperature decrease of the fixing rotating member due to ejected air is suppressed, so that poor imaging caused by temperature decrease of the fixing rotating member can be prevented. Further, since a heater for heating air becomes unnecessary, power consumption can be reduced and cost can be reduced.

Further features of the present invention will become apparent from the following description of exemplary embodiments with reference to the attached drawings.

DESCRIPTION OF THE EMBODIMENTS

In the following, embodiments of the present invention will be described in detail with reference to the drawings.

The First Embodiment

Figure 1:
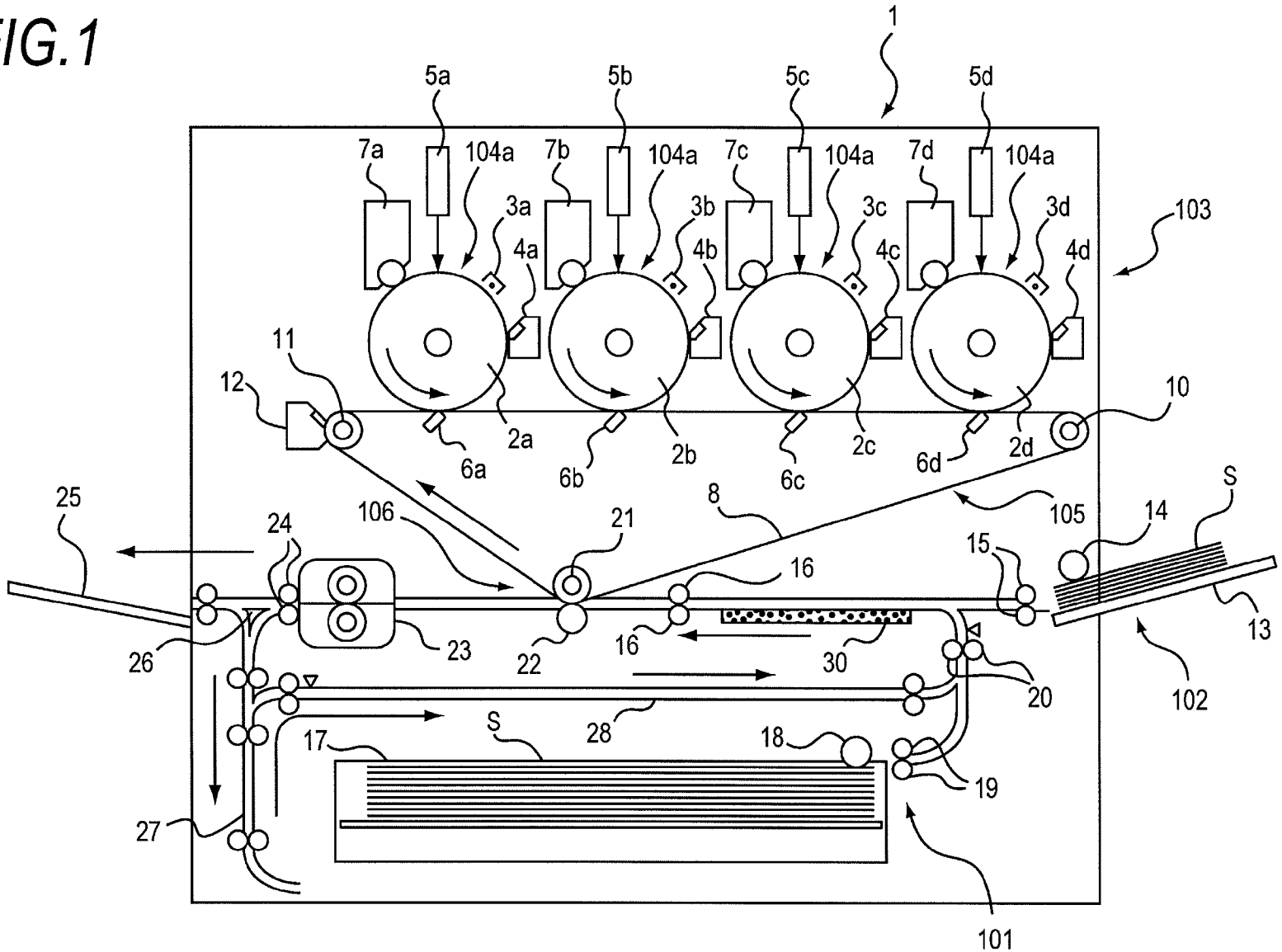
FIG. 1 is an explanatory view which illustrates the general configuration of a printer as an example of an image forming apparatus according to a first embodiment of the present invention.

FIG. 1 is an explanatory view which illustrates the general configuration of a printer as an example of an image forming apparatus according to a first embodiment of the present invention. Here, the printer performs color-printing of an original image with toner images of four colors of yellow, magenta, cyan and black. A printer 1 in FIG. 1 is a printer as an image forming apparatus. The printer 1 includes a sheet feeding portion 101 to feed a sheet S, a manual feeding portion 102 and an image forming portion 103 to form an image (i.e., a toner image) on the sheet S.

The image forming portion 103 has an image forming unit 104 (104*a*, 104*b*, 104*c*, 104*d*) for each color (yellow, magenta, cyan and black) for forming. The image forming unit 104 has a photosensitive drum 2 (2*a*, 2*b*, 2*c*, 2*d*) as an image bearing member. The image forming unit 104 is provided with a charger 3 (3*a*, 3*b*, 3*c*, 3*d*) to evenly charge the surface of the photosensitive drum 2 and a laser scanning unit 5 (5*a*, 5*b*, 5*c*, 5*d*) to form an electrostatic latent image on the photosensitive drum 2. Further, the image forming unit 104 is provided with a development unit 7 (7*a*, 7*b*, 7*c*, 7*d*) to develop the electrostatic latent image on the photosensitive drum 2 formed with exposure by the laser scanning unit 5. Further, the image forming unit 104 is provided with a cleaner 4 (4*a*, 4*b*, 4*c*, 4*d*) to eliminate toner remaining on the photosensitive drum 2. The photosensitive drum 2 is configured to be driven to rotate by a drive portion (not illustrated) counterclockwise as illustrated by an arrow in FIG. 1, for example. The charger 3, the laser scanning unit 5, the development unit 7 and the cleaner 4 are sequentially arranged around the photosensitive drum 2 along the rotation direction thereof.

Further, the printer 1 is provided with an intermediate transfer portion 105 having an intermediate transfer belt 8 as an intermediate transfer member and a primary transfer blade 6 (6*a*, 6*b*, 6*c*, 6*d*) as a primary transfer portion to primarily transfer a toner image formed on the photosensitive drum 2 to the intermediate transfer belt 8. Further, the printer 1 is provided with a secondary transfer roller 22 as a secondary transfer portion to secondarily transfer the toner image on the intermediate transfer belt 8 to the sheet S and a fixing portion 23 to fix the toner image on the sheet S. Further, the printer 1 is provided with a pair of registration rollers 16 to convey the sheet S to the secondary transfer roller 22. The pair of registration rollers 16 is arranged upstream in the sheet conveying direction of the secondary transfer roller 22. Furthermore, the printer 1 is provided with a pair of discharge rollers 24 which is arranged downstream in the sheet conveying direction of the fixing portion 23 and which discharges the toner-fixed sheet S to the outside of the main body, and a discharge tray 25 to receive the sheet S discharged by the pair of discharge rollers 24.

The image forming units 104 are serially arranged in the horizontal direction respectively along the intermediate transfer belt 8. The primary transfer blade 6 is oppositely arranged at the position to nip the intermediate transfer belt 8 with the photosensitive drum 2. The intermediate transfer portion 105 is provided with tension rollers 10, 11, and a secondary transfer counter roller 21, and then, the intermediate transfer belt 8 is stretched around the three rollers 10, 11, 21. A cleaner 12 is arranged at the position to nip the intermediate transfer belt 8 being opposed to the tension roller 11. Remaining toner after transfer stuck to the surface of the intermediate transfer belt 8 is to be eliminated by the cleaner 12. Further, the secondary transfer roller 22 is oppositely arranged at the position to nip the intermediate transfer belt 8 with the secondary transfer counter roller 21. A transfer portion 106 to transfer a toner image to the sheet S is constituted with the secondary transfer counter roller 21, the intermediate transfer belt 8 and the secondary transfer roller 22.

The sheet feeding portion 101 is provided with a sheet cassette 17 as a sheet stack portion to which the sheet S is stacked, a pickup roller 18 to pick up the sheet S in the sheet cassette 17, and a pair of retard rollers 19 to separate and convey the sheet S one by one. The manual feeding portion 102 is provided with a manual tray 13 on which the sheet S is stacked, a pickup roller 14 to pick up the sheet S on the manual tray 13 and a pair of retard rollers 15 to separate and convey the sheet S one by one.

Next, image forming operation of the printer 1 as structured above will be described. When a print command is received from an external host computer (not illustrated), the image forming operation is started. Firstly, at the image forming unit 104*a* of yellow, for example, the surface of the photosensitive drum 2*a* is negatively charged by the charger 3*a*. Then, image exposure is performed by the laser scanning unit 5*a*. As a result, an electrostatic latent image corresponding to a yellow image component of an original is formed on the surface of the photosensitive drum 2*a*. Next, the electrostatic latent image is developed by the development unit 7*a* with yellow toner so as to be visualized as a yellow toner image. Then, the yellow toner image obtained as described above is primarily transferred on the intermediate transfer belt 8 by the primary transfer blade 6*a* to which transfer bias is applied. Here, after the toner image is transferred, the remaining toner after the transfer stuck to the surface of the photosensitive drum 2*a* is eliminated by the cleaner 4*a*, and then, the photosensitive drum 2*a* is utilized for the next image forming. Then, the toner image forming operation as described above is performed by other image forming units 104*b*, 104*c* and 104*d* respectively at predetermined timing. Further, respective color toner images formed respectively on the photosensitive drums 2*b*, 2*c* and 2*d* are primarily transferred on the intermediate transfer belt 8 as being sequentially superimposed by the respective primary transfer blade 6*b*, 6*c* and 6*d*. By sequentially transferring and superimposing the toner image on the photosensitive drum 2 of each color on the opposed intermediate transfer belt 8 in order by color, a single full-color toner image which is electrostatically adsorbed is formed on the intermediate transfer belt 8. Next, the four-color toner image transferred on the intermediate transfer belt 8 is moved to a nip which is formed by the secondary transfer counter roller 21 and the secondary transfer roller 22 in accordance with rotation of the intermediate transfer belt 8 in the arrow direction.

Meanwhile, along with such toner image forming operation, the sheet S is fed from the sheet feeding portion 101 or the manual feeding portion 102. The sheet S fed from the sheet feeding portion 101 is conveyed to an electrostatic conveying portion 30 by a pair of longitudinal path rollers 20. The sheet S fed from the manual feeding portion 102 is conveyed directly to the electrostatic conveying portion 30. The sheet S conveyed to the electrostatic conveying portion 30 is corrected in lateral registration, and then, is conveyed to the pair of registration rollers 16. At that time, the rotation of the pair of registration rollers 16 remain stopped. Accordingly, by being bumped to the nip of the pair of registration rollers 16, skew feeding of the sheet S is corrected. After the skew feeding is corrected, the sheet S is conveyed to the transfer portion 106 at predetermined timing by the pair of registration rollers 16. Then, the toner image on the intermediate transfer belt 8 is transferred onto the sheet S at the secondary transfer roller 22 to which the transfer bias is applied. Next, the sheet S having the toner image transferred is conveyed to the fixing portion 23. At the fixing portion 23, heat and pressure are applied to the sheet S and the toner on the sheet S is melted and fixed. The sheet S having the toner image fixed by the fixing portion 23 is discharged onto the discharge tray 25 by a pair of discharge rollers 24.

In the case that image forming is performed on both faces of the sheet S, the sheet S having passed through the fixing portion 23 is guided to a reverse path 27 due to operation of a switching member 26. After being switched back at the reverse path 27 and conveyed to a duplex path 28, the sheet S is re-conveyed to the transfer portion 106. Then, the sheet S having the toner image transferred at the transfer portion 106 and having the toner image fixed at the fixing portion 23 is discharged onto the discharge tray 25 by the pair of discharge rollers 24.

Figure 2:
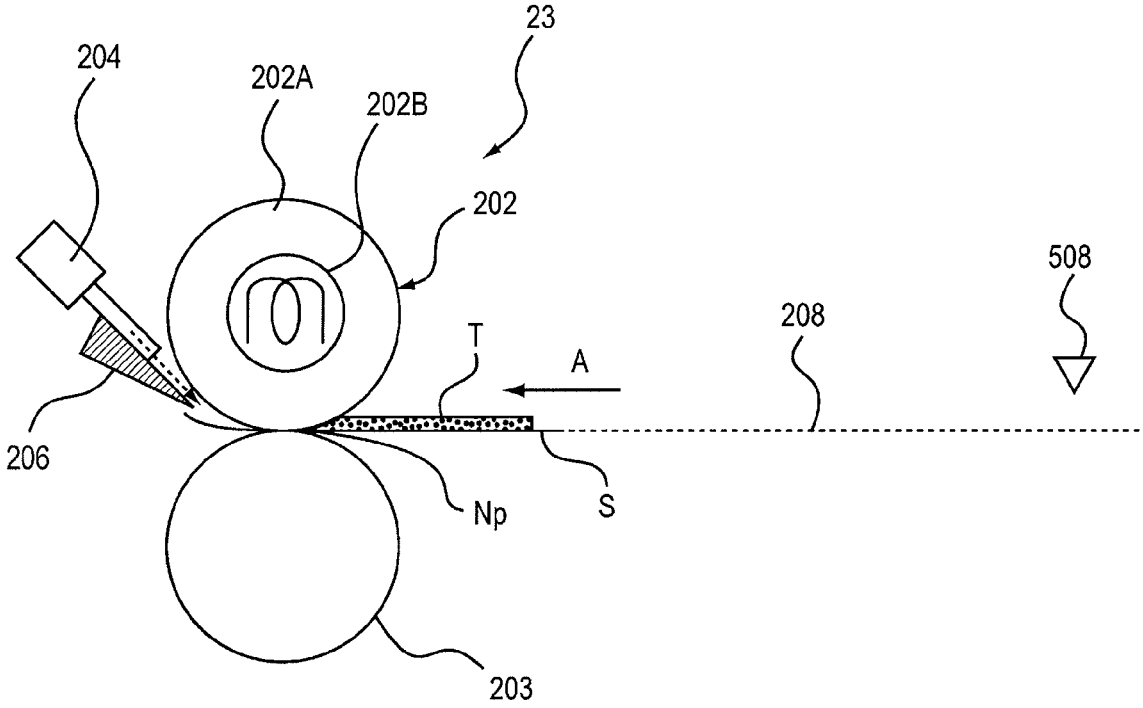
FIG. 2 is an explanatory view which illustrates a fixing portion of the printer and devices arranged at the vicinity thereof.

FIG. 2 is an explanatory view of the fixing portion 23 and devices arranged at the vicinity thereof of the printer 1. The fixing portion 23 includes a heat roller 202 as a fixing rotating member and a pressure roller 203 as a pressing rotating member. The heat roller 202 includes a roller body 202A and a heater 202B as a heating source. The pressure roller 203 is arranged below the heat roller 202 being opposed thereto. Then, the pressure roller 203 is pressure-contacted to the heat roller 202, so that a nip portion Np is formed.

The sheet S having non-fixed toner T transferred on a surface is transferred in the direction of arrow A in FIG. 2. Then, the sheet S is heated and pressed by the nip portion Np between the heat roller 202 including the heater 202B and the pressure roller 203. Accordingly, the transferred non-fixed toner T is melted and fixed on the sheet S. A peeling guide plate 206 is arranged at the vicinity of the heat roller 202 downstream in the sheet conveying direction thereof.

In the present first embodiment, the printer 1 is provided with an air ejecting portion 204 to eject compressed air, the portion being arranged above the peeling guide plate 206 and at a gap between the peeling guide plate 206 and the heat roller 202. Further, the printer 1 is provided with a sheet detecting sensor 508 as a sheet detecting portion to detect passing sheet S, the sensor being arranged upstream in the sheet conveying direction of the fixing portion 23 and at a conveying path 208 between the transfer portion 106 and the fixing portion 23. The sheet detecting sensor 508 is utilized to generate ejection timing of the air to be sprayed to the sheet top end by the air ejecting portion 204.

Figure 3A:
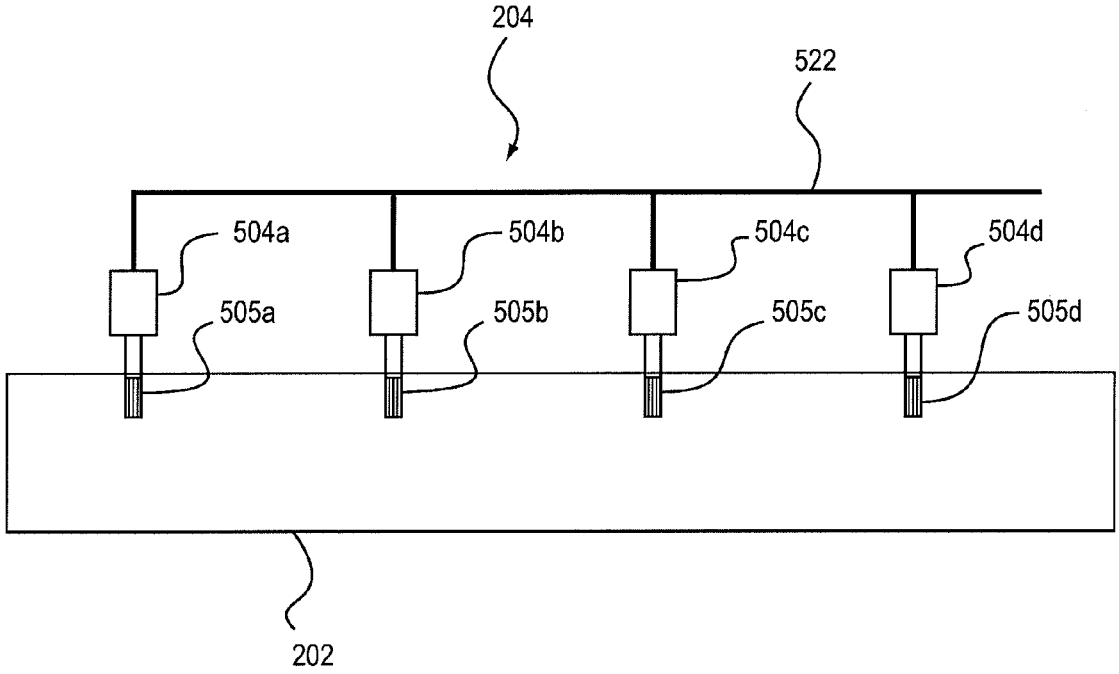
FIG. 3A is a layout view of an air ejecting portion against a heat roller illustrated in the vicinity thereof.

As illustrated in FIG. 3A, the air ejecting portion 204 is provided with air nozzles 505*a* to 505*d* as four (i.e., plural) nozzles arranged in parallel along the axis direction of the heat roller 202 so as to be capable of ejecting air toward the gap between the sheet top end and the circumference of the heat roller 202. The axis direction of the heat roller 202 is in parallel to the width direction which is perpendicular to the sheet conveying direction.

Further, the air ejecting portion 204 is provided with electromagnetic valves 504*a* to 504*d* as four (i.e., plural) control valves respectively connected to the air nozzles 505*a* to 505*d*. The electromagnetic valves 504*a* to 504*d* are connected with a connection pipe 522, so that the air having appropriate pressure is supplied to the electromagnetic valves 504*a* to 504*d* via the connection pipe 522. The air nozzles 505*a* to 505*d* and the electromagnetic valves 504*a* to 504*d* are respectively connected with connection pipes 523 to 526 (see FIG. 4). The air nozzles 505*a* to 505*d* are respectively arranged to direct toward the nip portion Np of the heat roller 202 and the pressure roller 203 (see FIG. 2). The air ejected from the respective air nozzles 505*a* to 505*d* is sprayed to the nip portion Np along the heat roller 202 and the peeling guide plate 206 as illustrated by a dotted line in FIG. 2.

Here, the air ejected from the respective air nozzles 505*a* to 505*d* being compressed air like intermittent pulses is instantaneously splayed toward the gap between the top end of the sheet S having passed through the nip portion Np and the circumference of the heat roller 202. Accordingly, when the sheet S is stuck to the heat roller 202, the sheet S can be peeled from the heat roller 202. Subsequently, since the sheet S is peeled from the heat roller 202 by being guided by the peeling guide plate 206, it becomes unnecessary to eject air from the respective air nozzles 505*a* to 505*d* against this sheet S.

By the way, in the present first embodiment, the air ejecting portion 204 includes the air nozzles 505*a* to 505*d* and the electromagnetic valves 504*a* to 504*d* and is capable of ejecting air selectively from four (i.e., plural) air ejection positions arranged in the width direction which is perpendicular to the sheet conveying direction. That is, by selectively opening the electromagnetic valves 504*a* to 504*d*, the air can be ejected from not all but any of the four air nozzles 505*a* to 505*d*. Accordingly, in the case that the temperature of the heat roller 202 is decreased in part due to air ejection from an air ejection position by an air nozzle, excessive temperature decrease of the heat roller 202 can be prevented by changing the air ejection position to eject air from another air nozzle.

Figure 3B:
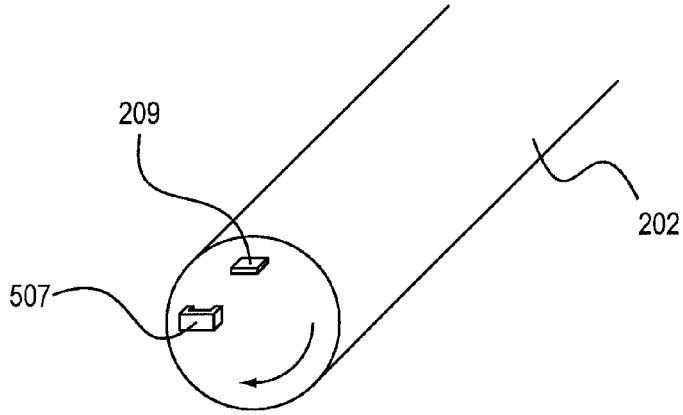
FIG. 3B is a general structural view of an HP flag piece to detect a home position of the heat roller and an HP detection sensor illustrated in the vicinity of the heat roller.

As illustrated in FIG. 3B, at a side end face of the heat roller 202, an HP flag piece 209 is arranged at a position corresponding to a home position (HP) beinairpecific rotational position of the heat roller 202. An HP sensor 507 is arranged at the main body of the printer 1 as a sensor capable of detecting the home position of the heat roller 202. The HP sensor 507 being a transmission photo-interrupter outputs a pulse at the time when an arrival of the HP flag piece 209 due to rotation of the heat roller 202 is detected. That is, the HP sensor 507 outputs a pulse for each rotation having a pulse cycle corresponding to the rotation speed of the heat roller 202.

Figure 4:
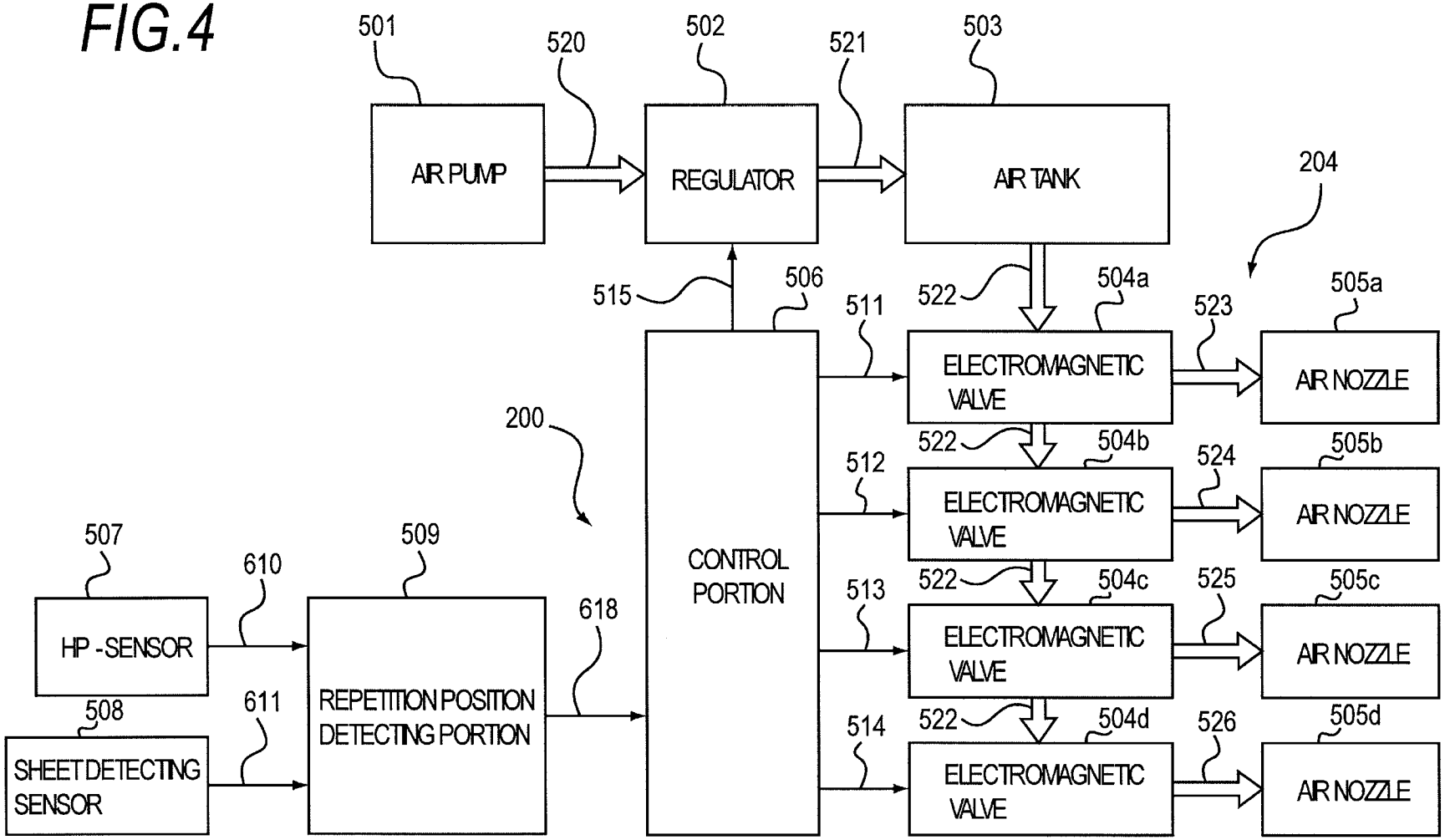
FIG. 4 is a block diagram which illustrates the general configuration of the air ejecting portion and a control unit thereof.

As illustrated in FIG. 4, the air ejecting portion 204 includes an air pump 501, a regulator 502 and an air tank 503.

The air pump 501 pressure-feeds compressed air to the regulator 502 via a pipe 520. The regulator 502 performs pressure-feeding via a pipe 521 while adjusting pressure of the compressed air pressure-fed from the air pump 501, so that the pressure in the air tank 503 is adjusted to be constant. The air tank 503 is to store the air to be fed to air nozzles 505*a* to 505*d*. Then, the connection pipe 522 (see FIG. 3) is connected to the air tank 503, so that compressed air can be ejected toward the heat roller 202 at predetermined timing from the air nozzles 505*a* to 505*d* via the respective electromagnetic valves 504*a* to 504*d*.

A control unit 200 includes a control portion 506, the HP sensor 507, the sheet detecting sensor 508, a repetition position detecting portion 509 and the like. The HP sensor 507 outputs an HP position detection signal 610 as a pulse to the repetition position detecting portion 509 at the time when the home position of the heat roller 202 is detected. Further, the sheet detecting sensor 508 (see FIG. 2) outputs a sheet detection signal 611 to the repetition position detecting portion 509 when the top end of the sheet S is detected. Based on the HP position detection signal 610 and the sheet detection signal 611, the repetition position detecting portion 509 outputs a repetition detection signal 618 indicating repetition information to the control portion 506 while counting the number of ejections corresponding to an air ejection position within predetermined time.

The control portion 506 is to control the entire printer and includes a CPU, a ROM, a RAM and the like. In the present first embodiment, the control portion 506 performs open-close control of the electromagnetic valves 504*a* to 504*d* and functions as a changing portion to change the air ejection position of the air ejecting portion 204. Further, the control portion 506 performs control of the regulator 502 to adjust the pressure of the compressed air in the air tank 503, control of conveying the sheet S, and the like. Specifically, the control portion 506 is capable of controlling compressed air to be ejected from the air nozzles 505*a* to 505*d* at predetermined timing by performing valve open-close while outputting control signals 511 to 514 to the electromagnetic valves 504*a* to 504*d*. That is, the control portion 506 performs appropriate selection among the air nozzles 505*a* to 505*d* in accordance with a paper type, grammage and size of the sheet S to be conveyed having a non-fixed toner formed and the repetition detection signal 618, and then, controls the electromagnetic valves 504*a* to 504*d* correspondingly. Further, the control portion 506 is capable of adjusting the pressure of the compressed air in the air tank 503 by outputting a control signal 515 to the regulator 502.

Next, the general configuration and operation of the repetition position detecting portion 509 will be described in detail. As illustrate in FIG. 5A, the repetition position detecting portion 509 includes a reference pulse generating portion 602, a heat roller position detecting portion 601 as a position data output portion, an ejection timing generating portion 603, an air ejection position detecting portion 604 as a detection portion, a memory portion 606 and a data comparing/counting portion 607.

Figure 6:
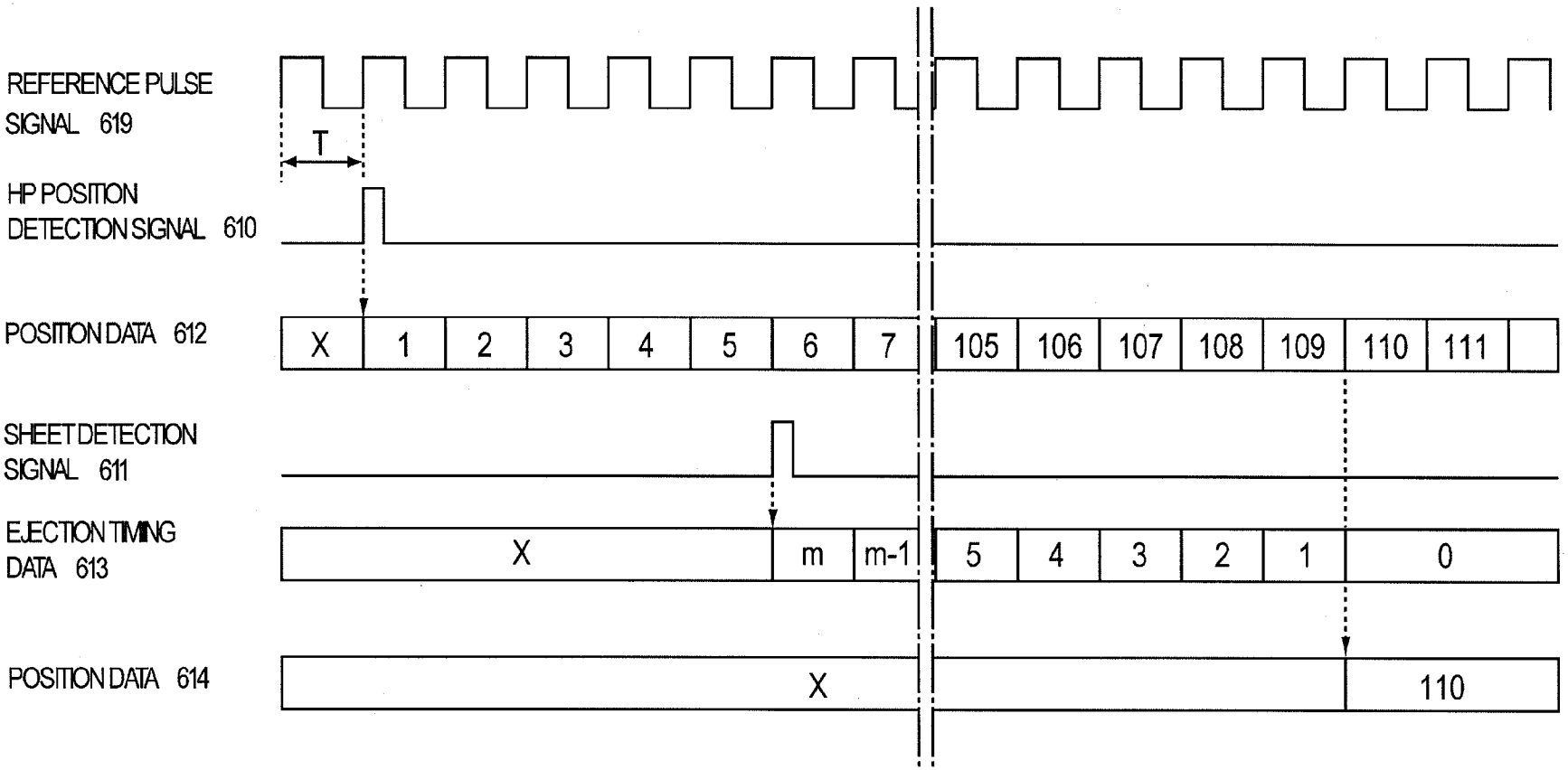
FIG. 6 is a timing chart which indicates operation of the repetition position detecting portion.

The reference pulse generating portion 602 outputs a reference pulse signal 619 having a predetermined cycle T as illustrated in FIG. 6 to the heat roller position detecting portion 601 and the ejection timing generating portion 603. The heat roller position detecting portion 601 receives the HP position detection signal 610 and the reference pulse signal 619 and detects the rotational position corresponding to the spraying position on the heat roller 202 at the time when the compressed air is ejected by the air nozzles 505*a* to 505*d*. Here, the heat roller position detecting portion 601 detects the rotational position having the home position of the heat roller 202 as a reference. Specifically, the heat roller position detecting portion 601 is an up-counter to count up the reference pulse signal 619 having the HP position detection signal 610 of a pulse as a trigger. Then, the heat roller position detecting portion 601 sequentially outputs position data 612 (i.e., count data) corresponding to the rotational position of the heat roller 202 having the home position detected by the HP sensor 507 as a reference. That is, the heat roller position detecting portion 601 counts up at the time when the HP position detection signal 610 as illustrated in FIG. 6 is detected and sequentially outputs the position data 612.

The ejection timing generation portion 603 receives the sheet detection signal 611 of the sheet detecting sensor 508 and the reference pulse signal 619 and generates ejection timing data 613 to eject the compressed air toward the top end of the sheet S. Specifically, the ejection timing generation portion 603 is a down-counter to count down the reference pulse signal 619 having the sheet detection signal 611 as a trigger. A starting value m for the countdown is acquired with an equation of m=s/P/T. Here, s denotes distance from the sheet detecting sensor 508 to the air ejection position, P denotes sheet conveying speed, and T denotes a cycle of the reference pulse signal 619. That is, the ejection timing generation portion 603 starts the countdown from the starting value m when a pulse indicating the sheet detection signal 611 as illustrated in FIG. 6 is detected.

The air ejection position detecting portion 604 receives the position data 612 and the ejection timing data 613 and outputs position data 614. That is, the air ejection position detecting portion 604 obtains the position data 612 at the time when the ejection timing data 613 becomes zero, namely, at the time when air is to be ejected, and outputs the obtained position data 612 to the memory portion 606 as the position data 614. Accordingly, the air ejection position detecting portion 604 detects the position data 614 indicating the rotational position of the heat roller 202 at the time when air is ejected from the air ejecting portion 204. For example, as illustrated in FIG. 6, the air ejection position detecting portion 604 outputs the data indicating "110" which is the position data 612 obtained at the time when the ejection timing data 613 becomes zero to the memory portion 606 as the position data 614.

The memory portion 606 is to sequentially store the input position data 614. As illustrated in FIG. 5B, the memory portion 606 is allocated to n+1 pieces (i.e. a plurality) of memory areas to store the previously input position data 614. In each memory area, the top address is indicated by "st_adrs" and the last address is indicated by "st_adrs+n". Every time the position data 614 is input, the address is incremented by one and data storing is sequentially performed. Accordingly, the position data PD0 to PDn are to be stored respectively at the addresses "st_adrs" to "st_adrs+n". When the input position data 614 is stored at the last address "st_adrs+n", the address is returned to the top address "st_adrs". In this manner, the latest position data PD0 to PDn of n+1 pieces are consistently stored. It is preferable that the number of pieces n+1 of the position data PD0 to PDn is set to be the number of sheets corresponding to temperature recovery time or longer of the heat roller 202 having decreased temperature to cause poor fixing performance by being splayed with the compressed air.

Figure 5A:
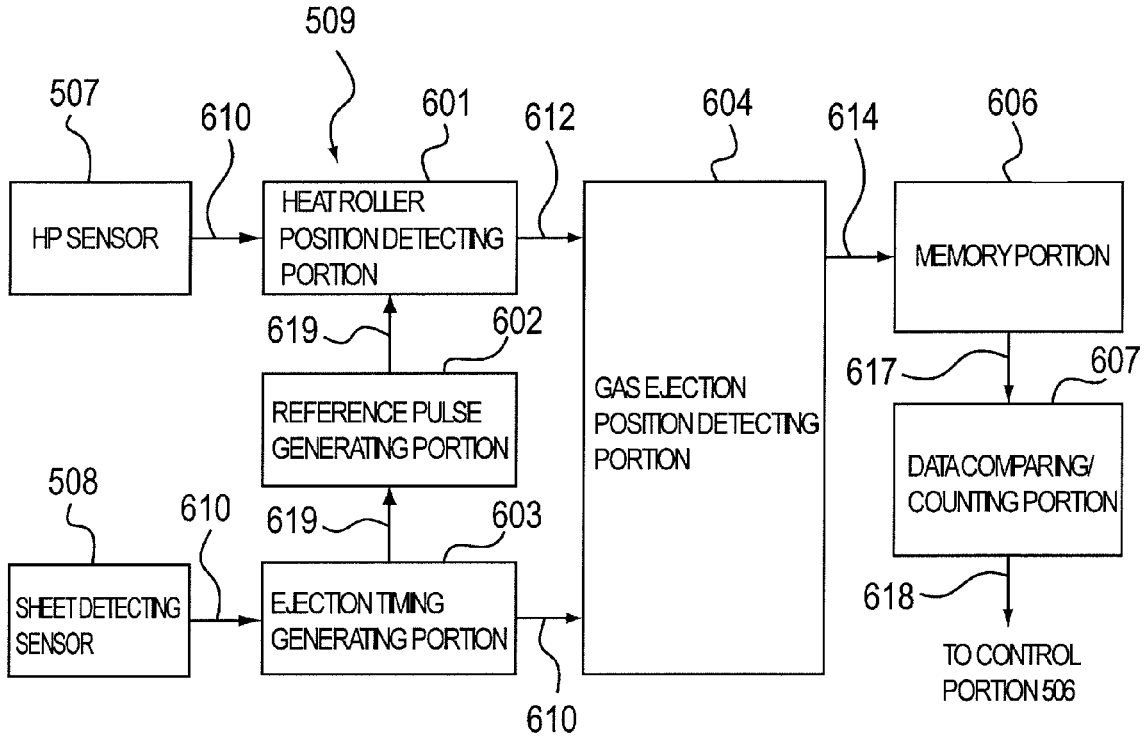
FIG. 5A is a block diagram of a repetition position detecting portion illustrated in the general configuration thereof.
Figure 5B:
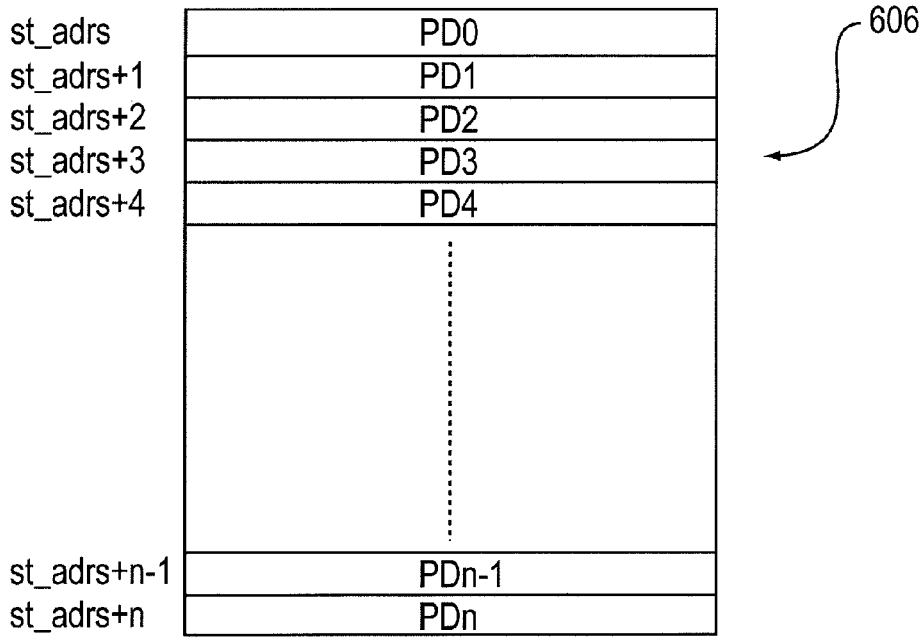
FIG. 5B is an explanatory view which illustrates the general configuration of a memory portion of the repetition position detecting portion.

The data comparing/counting portion 607 as illustrated in FIG. 5A compares the latest position data (for example, PDn) which is lastly stored at the memory portion 606 with the position data of the previous n pieces (for example, PD0 to PDn−1). Then, the data comparing/counting portion 607 determines whether or not the latest position data PDn stored at the memory portion 606 is matched to the rest of the position data PD0 to PDn−1. When the number of the repetition position data reaches a predetermined number N, the data comparing/counting portion 607 outputs the repetition detection signal 618 to the control portion 506.

Figure 7:
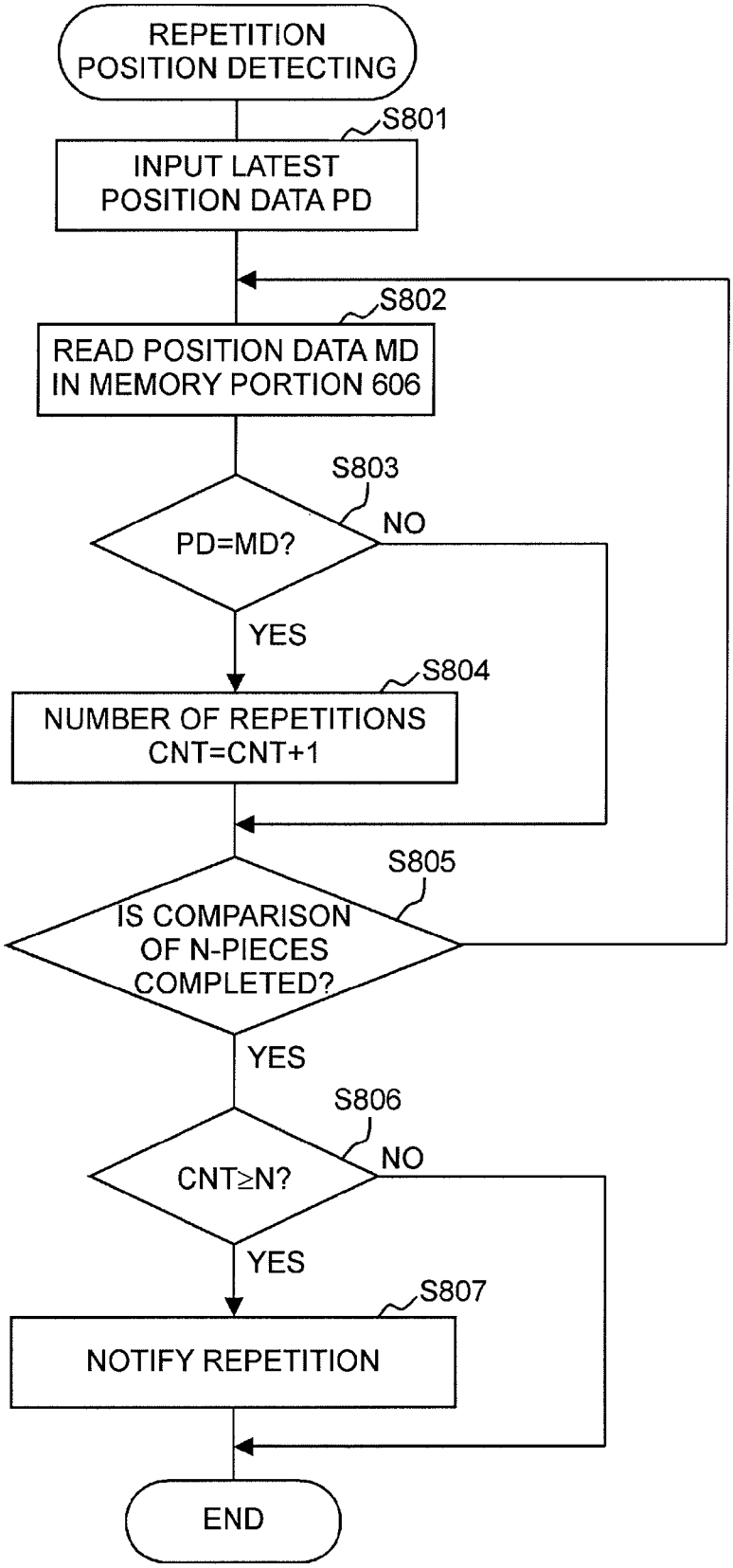
FIG. 7 is a flowchart which describes operation of a data comparing/counting portion.

Next, the operation of the data comparing/counting portion 607 will be described in detail with reference to a flowchart of FIG. 7. First, the latest position data PD is input from the memory portion 606 to the data comparing/counting portion 607 (S801). Next, the first position data MD which is previously stored at the memory portion 606 is input to the data comparing/counting portion 607 (S802). Then, the data comparing/counting portion 607 compares the input latest position data PD with the position data MD (S803). When the comparison result is "true" (i.e., "Yes" in S803), the data comparing/counting portion 607 adds one to a repetition number counter CNT (S804). When the comparison result is "false" (i.e., "No" in S803), it proceeds to the next. The data comparing/counting portion 607 determines whether or not the comparison with the position data of the past n pieces is completed (S805). When not completed (i.e., "No" in S805), the data comparing/counting portion 607 receives the next position data MD from the memory portion 606 as proceeding to the process of S802, and repeatedly performs, in the similar manner, the comparison between the latest position data PD and the position data MD.

When the comparison with the position data of the past n pieces is completed (i.e., "Yes" in S805), the data comparing/counting portion 607 compares the repetition number CNT with a predetermined number N which is previously defined (S806). In the case of CNT≧N (i.e., "Yes" in S806), the data comparing/counting portion 607 determines that the air ejection position is repeated and then, outputs the repetition detection signal 618 to the control portion 506 (S807). That is, when the number of the same position data as the latest position data which is lastly stored reaches the predetermined number N (i.e., "Yes" in S806), the data comparing/counting portion 607 outputs the repetition detection signal 618 to the control portion 506 (S807).

Here, the predetermined number N is set to be smaller than the number of air ejections with which the temperature of the heat roller 202 decreases to the surface temperature causing poor imaging due to poor fixing when the air is ejected to the same position in the circumference of the heat roller 202. That is, poor imaging does not occur when the number of air ejections at the same position in the circumference of the heat roller 202 becomes the predetermined number N. The predetermined number N is a previously determined value from experiment.

In the case of CNT<N (i.e., "No" in S806), the data comparing/counting portion 607 ends the data comparison without outputting the repetition detection signal 618 since the air ejection position is not repeated or poor fixing by the fixing portion 23 is not caused even through being repeated.

Figure 8:
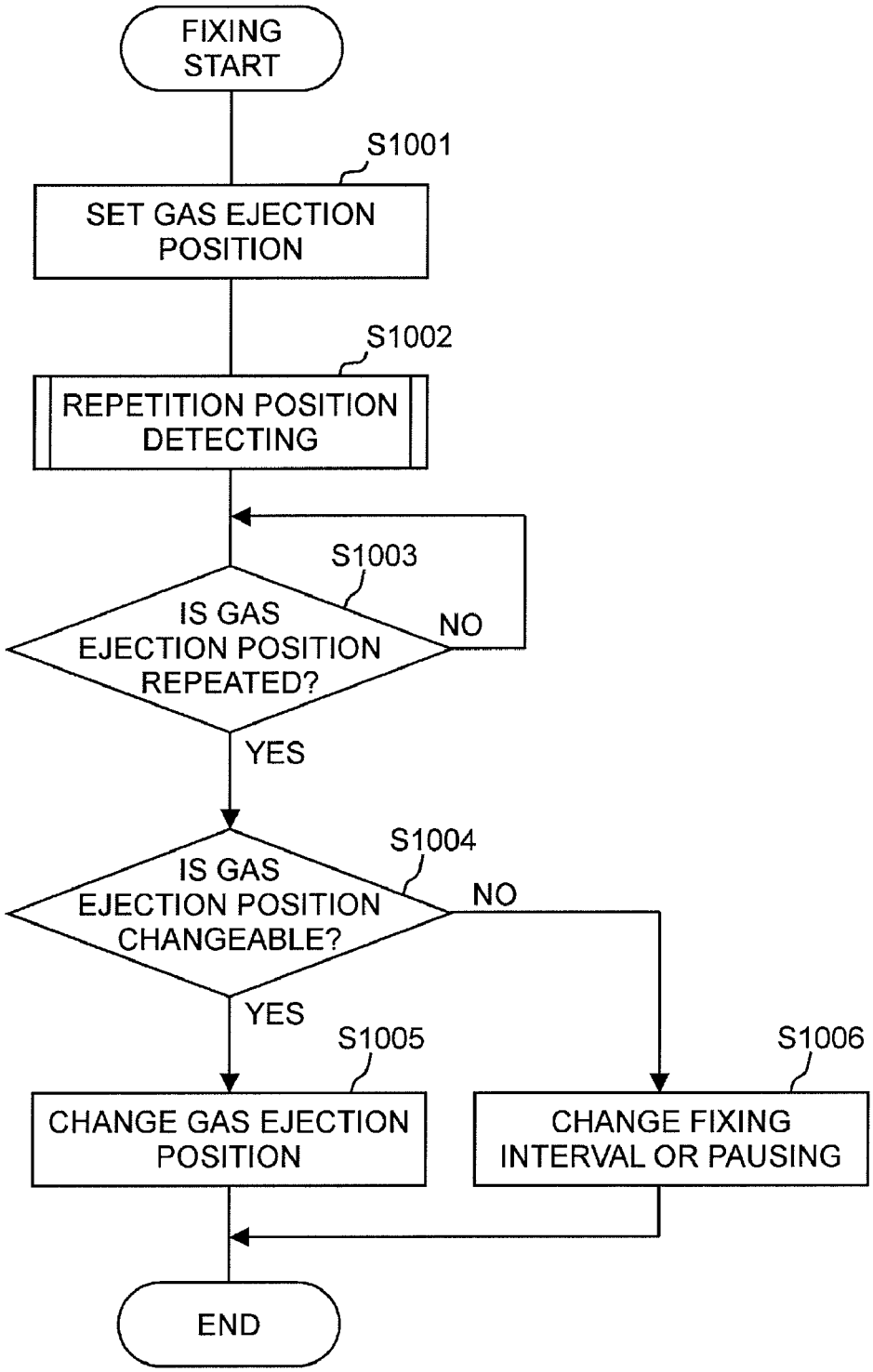
FIG. 8 is a flowchart which describes control operation of respective portions of the control unit.

Next, control operation of the respective portions of the control unit 200 will be described in detail with reference to a flowchart of FIG. 8. Here, the present first embodiment will be described in the case of changing air ejection position utilizing two air nozzles among the four air nozzles 505*a* to 505*d*. When the fixing operation at the fixing portion 23 is started, the control portion 506 firstly selects the air nozzles 505*a* and 505*d* to set the first air ejection positions (S1001). That is, the control portion 506 selects, for example, the electromagnetic valves 504*a* and 504*d* as the control objects. Next, the data comparing/counting portion 607 performs the routine of repetition position detecting described in FIG. 7 (S1002).

The control portion 506 determines whether or not the repetition of the air ejection position exists, namely, whether or not the repetition detection signal 618 has been input from the data comparing/counting portion 607 (S1003). That is, the repetition detection signal 618 is the signal to indicate that the number of the position data being the same as the lastly stored position data among the plurality of position data stored at the memory portion 606 has reached the predetermined number N. Accordingly, the control portion 506 determines whether or not the number of the position data being the same as the latest position data which is lastly stored reaches the predetermined number N.

When the repetition detection signal 618 is input (i.e., "Yes" in S1003), namely, the number has reached the predetermined number N, the control portion 506 determines whether or not the air ejection position is changeable from the current position to another position (S1004). In this case, since the air ejection position which is not used on the current job still exists, the control portion 506 determines that the air ejection position is changeable (i.e., "Yes" in S1004). Next, the control portion 506 changes the air ejection positions by changing air nozzles to eject air to the air nozzles 505*b* and 505*c* (S1005). That is, the control portion 506 changes the control objects for open-close control from the electromagnetic valves 504*a* and 504*d* to the electromagnetic valves 504*b* and 504*c*. With this control, it is possible to prevent temperature decrease of the heat roller 202 of the fixing portion 23 due to the ejected air to the temperature causing poor fixing. Accordingly, it is possible to prevent poor imaging caused by the temperature decrease of the heat roller 202. In addition, by controllinair described above, since a heater for heating air is not required, it is possible to achieve cost reduction and power consumption reduction of the apparatus. In the case that the air ejection position is changed as described above, the position data PD0 to PDn are reset (i.e., deleted) in order to avoid mixing with the position data stored after changing.

Here, the control portion 506 counts predetermined time required for recovering the fixing temperature from the timing of the air ejection position change or the timing of the last air ejection. Then, the control portion 506 prohibits to change the position to the air ejection position before the changing (i.e., the use of the air nozzles 505*a* and 505*d*) until the predetermined time required for recovery of the fixing temperature passes. Even when the air nozzles 505*b* and 505*c* are used after the air ejection position change of this time, there may be a case that the control portion 506 detects the repetition detection signal 618 similarly in the process of S1003. At that time, when the predetermined time required for fixing temperature recovery is passed, the control portion 506 determines that the air ejection position is changeable (i.e., "Yes" in S1004). However, when the predetermined time is not passed, it is not possible to change to the air ejection position where the changing is prohibited. Therefore, when all of the other air nozzles are unusable, the control portion 506 determines that changing of the air ejection position is not allowed (i.e., "No" in S1004).

Then, the control portion 506 enlarges a conveying interval of the sheet S (i.e., sets from the first conveying interval to the second conveying interval being larger than the first conveying interval) or temporarily halts fixing operation while halting the conveying of the sheet S (S1006). In specific description, in the case of enlarging the conveying interval of the sheet S, the control portion 506 controls to delay the sheet feeding timing from the sheet cassette 17. Meanwhile, in the case of halting the conveying of the sheet S, the control portion 506 controls to halt the feeding of the sheet S from the sheet cassette 17. At that time, while detecting the temperature of the heat roller 202 of the fixing portion 23, the control portion 506 selects whether to halt the conveying of the sheet S or to enlarge the conveying interval of the sheet S in accordance with the temperature decrease. For example, in the case that the detected temperature is equal to or lower than a first temperature and higher than a second temperature which is lower than the first temperature, the control portion 506 enlarges the conveying interval of the sheet S so as to gradually recover the temperature of the heat roller 202. Meanwhile, when the detected temperature is equal to or lower than the second temperature, the control portion 506 halts the conveying of the sheet S so as to quickly recover the temperature of the heat roller 202.

Next, in the case that the predetermined time is passed after the last air ejection, the heat roller 202 is recovered to be the fixing temperature. Therefore, the control portion 506 resets the conveying interval of the sheet S from the second conveying interval to the first conveying interval or starts the conveying of the sheet S. Here, the predetermined time may be set to be different values between the cases of enlarging the conveying interval of the sheet S and halting the conveying of the sheet S or may be set to be the same value. For example, the time required for the temperature recovery in the case of halting the conveying of the sheet S may be determined based on the data such as the heat amount of the fixing portion 23 (i.e., the voltage of the heater 202B) and atmospheric temperature which are previously obtained from experiment. Further, the time required for temperature recovery in the case of enlarging the conveying interval may be determined by previously obtaining the data of heat quantity taken by the types and sizes of the sheet S from experiment and the like. Accordingly, when setting the predetermined time to count to be different values, and when setting the respective values to be the same, the larger value may be set. In this manner, the fixing temperature is recovered by enlarging the conveying interval of the sheet S or halting the conveying of the sheet S to temporary halt the fixing operation. Therefore, occurring of the poor imaging caused by temperature decrease of the fixing portion 23 can be prevented further effectively.

The Second Embodiment

Figure 9:
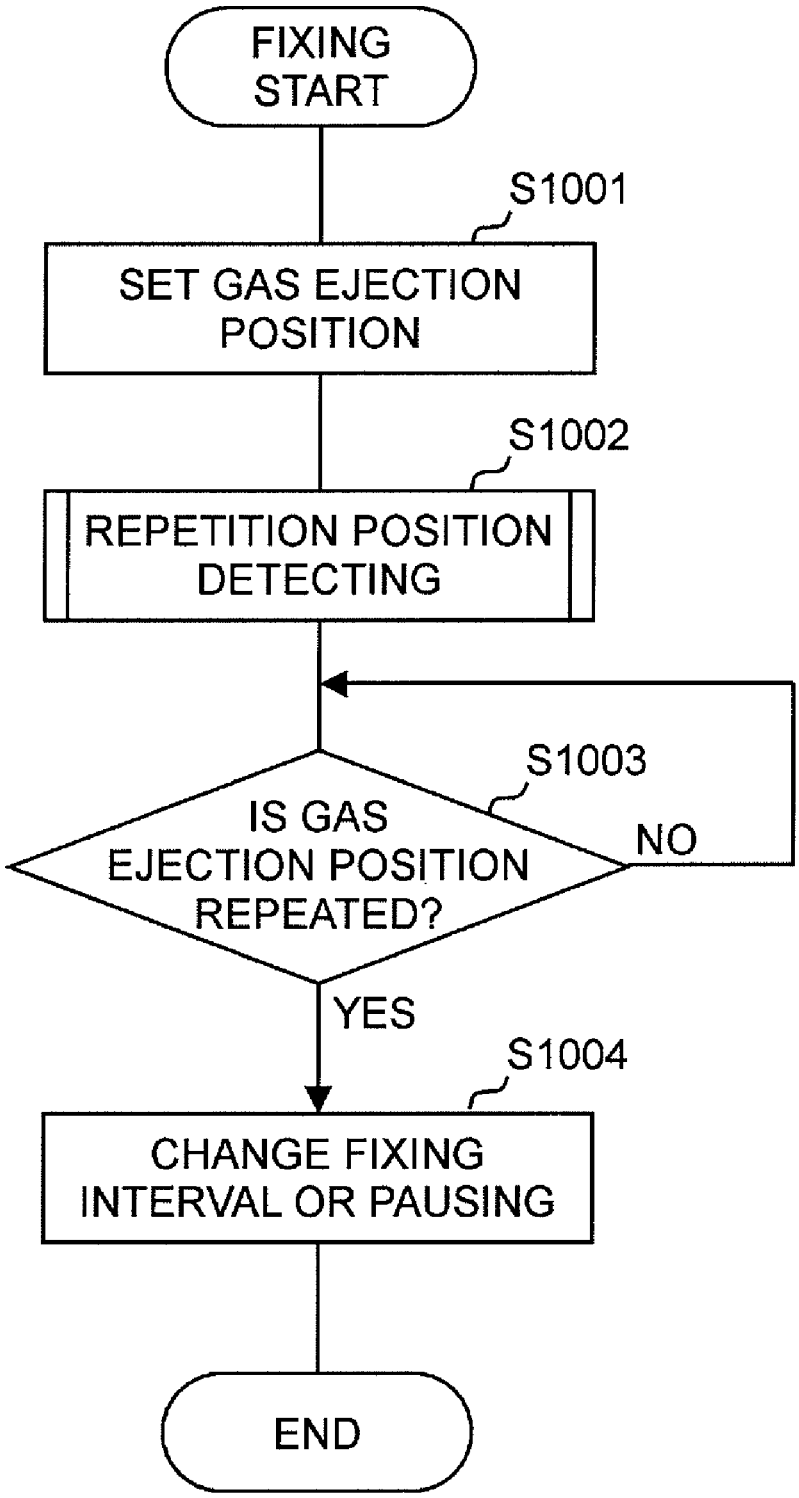
FIG. 9 is a flowchart which describes control operation of the control unit of the printer as an example of the image forming apparatus according to a second embodiment of the present invention.

FIG. 9 is a flowchart describing control operation of a control unit of a printer as an example of the image forming apparatus according to a second embodiment of the present invention. Here, since the apparatus configuration is similar to that of the first embodiment, the description will be performed with reference to FIGS. 1 to 7. When fixing operation at the fixing portion 23 is started, the control portion 506 selects some air nozzles, for example, the air nozzles 505*a* and 505*d*, among the plurality of air nozzles to set the air ejection positions (S1101). That is, the control portion 506 selects, for example, the electromagnetic valves 504*a* and 504*d* as the control objects. Next, the data comparing/counting portion 607 performs the routine of repetition position detecting described in FIG. 7 (S1102). The control portion 506 determines whether or not the repetition of the air ejection position exists, namely, whether or not the repetition detection signal 618 is input from the data comparing/counting portion 607 (S1103). When the repetition detection signal 618 is input (i.e., "Yes" in S1103), the control portion 506 enlarges the conveying interval of the sheet S or temporarily halts fixing operation while halting the conveying of the sheet S until the predetermined time is passed (S1104), as similar to the process of the S1006 in FIG. 8. Accordingly, in the present second embodiment as well, since the heat roller 202 of the fixing portion 23 is recovered to the fixing temperature, occurring of the poor imaging caused by temperature decrease of the fixing portion 23 can be prevented further effectively.

The Third Embodiment

In the above description of the first embodiment, it is described the case that the repetition position is detected by the repetition position detecting portion 509 (see FIG. 4). A third embodiment will be described in the case that the printer includes a repetition position predicting portion to predict the repetition position instead of the repetition position detecting portion 509. Here, in the description of the third embodiment, the same numeral is given to the same structure of the first embodiment and the description thereof will be omitted.

Figure 10:
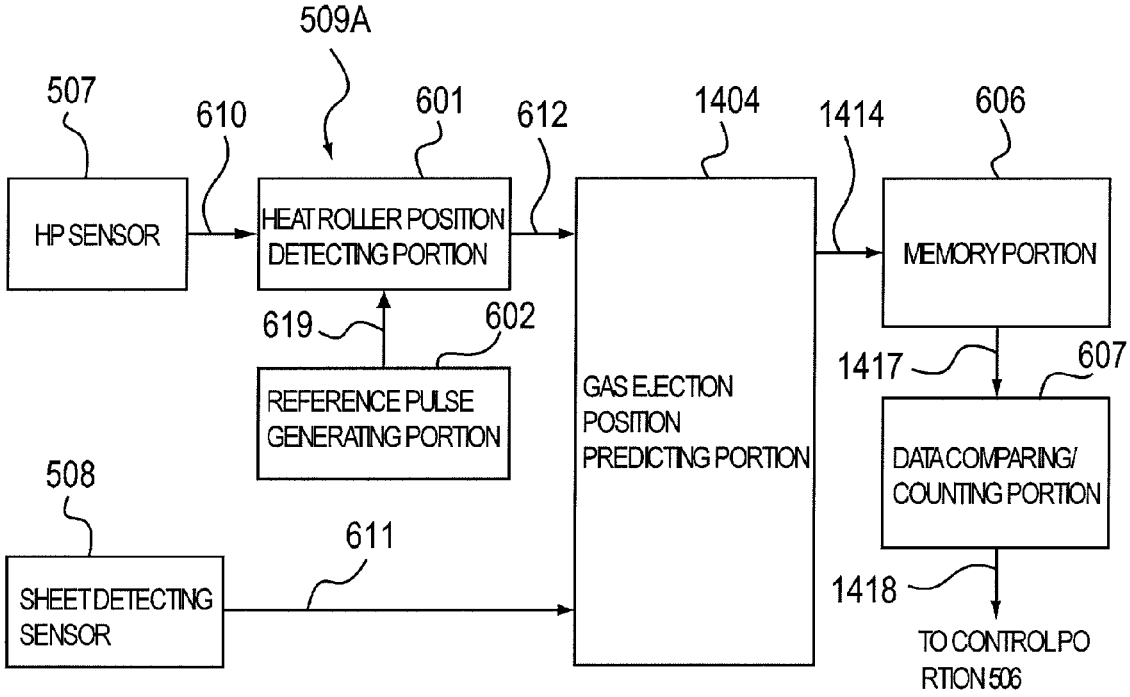
FIG. 10 is a block diagram which illustrates the general configuration of the repetition position predicting portion of the printer as an example of the image forming apparatus according to a third embodiment of the present invention.
Figure 11:
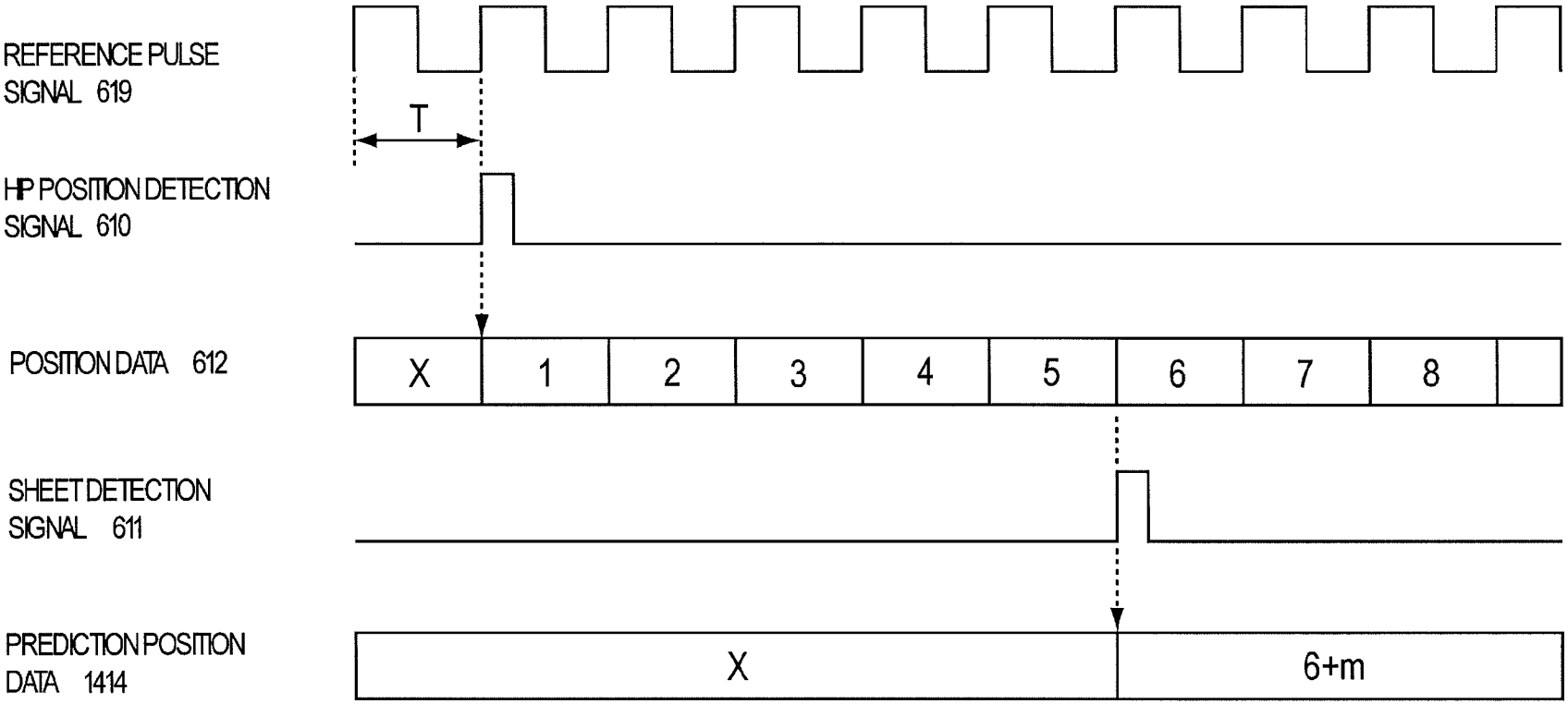
FIG. 11 is a timing chart which indicates operation of the repetition position predicting portion.

FIG. 10 is a block diagram which illustrates the general configuration of a repetition position predicting portion 509A of the printer as an example of the image forming apparatus according to the third embodiment of the present invention. FIG. 11 is a timing chart indicating operation of the repetition position predicting portion 509A. First, the repetition position predicting portion 509A will be described. Based on the HP position detection signal 610 input from the HP sensor 507 and the sheet detection signal 611 input from the sheet detecting portion 508, the repetition position predicting portion 509A outputs a repetition detection signal 1418 to the control portion 506. The repetition position predicting portion 509A includes the reference pulse generating portion 602, the heat roller position detecting portion 601 as a position data output portion, an air ejection position predicting portion 1404 as a predicting portion, the memory portion 606 and the data comparing/counting portion 607.

The reference pulse generating portion 602 outputs a reference pulse signal 619 having the predetermined cycle T as illustrated in FIG. 11 to the heat roller position detecting portion 601. The heat roller position detecting portion 601 receives the HP position detection signal 610 and the reference pulse signal 619 and detects the rotational position corresponding to the spraying position on the heat roller 202 at the time when the compressed air is ejected by any of the air nozzles 505*a* to 505*d*. Here, the heat roller position detecting portion 601 detects the rotational position having the home position of the heat roller 202 as a reference. Specifically, the heat roller position detecting portion 601 is an up-counter to count up the reference pulse signal 619 having the HP position detection signal 610 as a trigger. Then, the heat roller position detecting portion 601 sequentially outputs the position data 612 (i.e., count data) corresponding to the rotational position of the heat roller 202 having the home position detected by the HP sensor 507 as a reference. That is, the heat roller position detecting portion 601 counts up at the time when a pulse of the HP position detection signal 610 as illustrated in FIG. 11 is detected and sequentially outputs the position data 612.

The air ejection position predicting portion 1404 receives the position data 612 and the sheet detection signal 611 and outputs prediction position data 1414. In specific description, first, the air ejection position predicting portion 1404 latches and temporarily stores the position data 612 having the sheet detection signal 611 as an input trigger. For example, as illustrated in FIG. 11, the air ejection predicting portion 1404 latches and temporarily stores "6" as the position data 612 having the sheet detection signal 611 as the input trigger. That is, the air ejection position predicting portion 1404 obtains the position data 612 from the heat roller position detecting portion 601 at the sheet detection timing of the sheet detecting sensor 508.

Then, the air ejection position predicting portion 1404 adds the stored position data 612 (i.e., "6" in FIG. 11) to the starting value m as the previously calculated ejection timing count data and outputs the obtained value to the memory portion 606 as the prediction position data 1414. The starting value m is acquired with an equation of m=s/P/T. Here, denotes distance from the sheet detecting sensor 508 to the air ejection position, P denotes sheet conveying speed, and T denotes a cycle of the reference pulse single 619. Then, the countdown is performed from the starting value m at the sheet detection timing, and the air ejection is performed when the value becomes zero. That is, the air ejection position predicting portion 1404 obtains the prediction position data 1414 to be stored at the memory portion 606 based on the position data 612 from the heat roller position detecting portion 601 obtained at the sheet detection timing of the sheet detecting sensor 508. In this manner, the air ejection position predicting portion 1404 predicts the rotational position of the heat roller 202 at the time when air is ejected by the air ejecting portion 204 before the air ejecting portion 204 performs air ejection.

The memory portion 606 sequentially stores the prediction position data 1414 corresponding to the prediction rotational position from the air ejection position predicting portion 1404. Here, the configuration of the memory portion 606 is similar to that of the first embodiment. The data comparing/counting portion 607 compares the latest prediction position data which is lastly stored at the memory portion 606 with the prediction position data of the previous n pieces. Then, the data comparing/counting portion 607 determines whether or not the latest prediction position data stored at the memory portion 606 is matched to the rest of the prediction position data. When the number of the repeated prediction position data reaches a predetermined number N, the data comparing/counting portion 607 outputs the repetition detection signal 1418 to the control portion 506.

Figure 12:
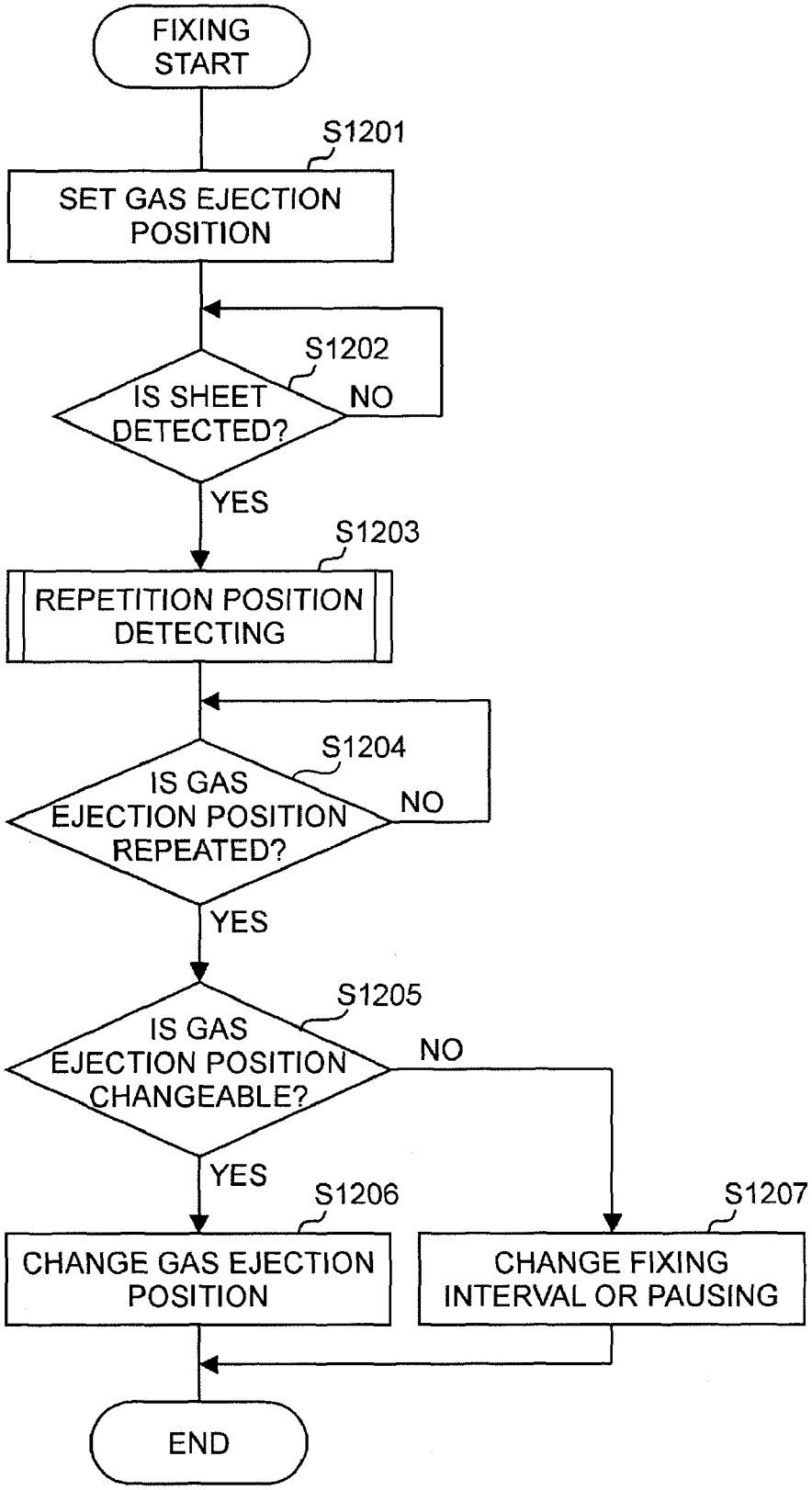
FIG. 12 is a flowchart which describes control operation of respective portions of the control unit.

FIG. 12 is a flowchart describing control operation of respective portions of the control unit. Here, the present third embodiment will be described in the case of changing air ejection position utilizing two air nozzles among the four air nozzles 505*a* to 505*d*.

When the fixing operation at the fixing portion 23 is started, the control portion 506 firstly selects the air nozzles 505*a* and 505*d* to set the first air ejection positions (S1201). That is, the control portion 506 selects, for example, the electromagnetic valves 504*a* and 504*d* as the control objects. The air ejection position predicting portion 1404 determines whether or not sheet detection is performed by the sheet detecting sensor 508, that is, whether or not the sheet detection signal 611 is input from the sheet detecting sensor 508 (S1202). When the sheet detection is performed (i.e., "Yes" in S1202), the air ejection position predicting portion 1404 obtains the position data 612 from the heat roller position detecting portion 601 at the sheet detection timing of the sheet detecting sensor 508, and then, obtains the prediction position data 1414 and outputs the obtained data to the memory portion 606. Subsequently, the data comparing/counting portion 607 performs the routine of repetition position detecting (see FIG. 7) being similar to the first embodiment (S1203).

The control portion 506 determines whether or not the repetition of the air ejection position exists, namely, whether or not the repetition detection signal 1418 has been input from the data comparing/counting portion 607 (S1204). That is, the repetition detection signal 1418 is the signal to indicate that the number of the prediction position data being the same as the lastly stored prediction position data among the plurality of prediction position data stored at the memory portion 606 has reached the predetermined number N. Accordingly, the control portion 506 is to determine whether or not the number of the prediction position data being the same as the latest prediction position data which is lastly stored reaches the predetermined number N.

When the repetition detection signal 1418 is input (i.e., "Yes" in S1204), namely, the number reaches the predetermined number N, the control portion 506 determines whether or not the air ejection position is changeable from the current position to another position (S1205). In this case, since the air ejection position which is not used on the current job still exists, the control portion 506 determines that the air ejection position is changeable (i.e., "Yes" in S1205). Next, the control portion 506 changes the air ejection positions by changing air nozzles to eject air to the air nozzles 505*b* and 505*c* (S1206). That is, the control portion 506 changes the control objects for open-close control from the electromagnetic valves 504*a* and 504*d* to the electromagnetic valves 504*b* and 504*c*. In the case that the air ejection position is changed as described above, the prediction position data PD0 to PDn of the memory portion 606 are reset (i.e., deleted) in order to avoid mixing with the prediction position data stored after changing.

Here, the control portion 506 counts predetermined time required for recovering the fixing temperature from the timing of the air ejection position change or the timing of the last air ejection. Then, the control portion 506 prohibits to change the position to the air ejection position before the changing (i.e., the use of the air nozzles 505*a* and 505*d*) until the predetermined time required for recovery of the fixing temperature passes. Even when the air nozzles 505*b* and 505*c* are used after the air ejection position change of this time, there may be a case that the control portion 506 detects the repetition detection signal 1418 similarly in the process of S1204. At that time, when the predetermined time required for fixing temperature recovery is passed, the control portion 506 determines that the air ejection position is changeable (i.e., "Yes" in S1205). However, when the predetermined time is not passed, it is not possible to change to the air ejection position where the changing is prohibited. Therefore, when all of the other air nozzles are unusable, the control portion 506 determines that changing of the air ejection position is not allowed (i.e., "No" in S1205). Then, similar to the process of S1006 of the first embodiment (see FIG. 8), the control portion 506 enlarges the conveying interval of the sheet S (i.e., sets from the first conveying interval to the second conveying interval being larger than the first conveying interval) or temporarily halts fixing operation while halting the conveying of the sheet S (S1207).

As described above, in the present third embodiment, the air ejection position is changed based on the plurality of prediction position data stored at the memory portion 606. Therefore, it is possible to change the air ejection position before the air is ejected to the heat roller 202 and switching of the control can be performed more rapidly.

Further, it is possible to prevent temperature decreasing of the heat roller 202 of the fixing portion 23 due to the ejected air to the temperature causing poor fixing. Accordingly, it is possible to prevent poor imaging caused by the temperature decrease of the heat roller 202. In addition, by controllinair described above, since a heater for heating air is not required, it is possible to achieve cost reduction of the apparatus and power consumption reduction.

The Fourth Embodiment

Figure 13:
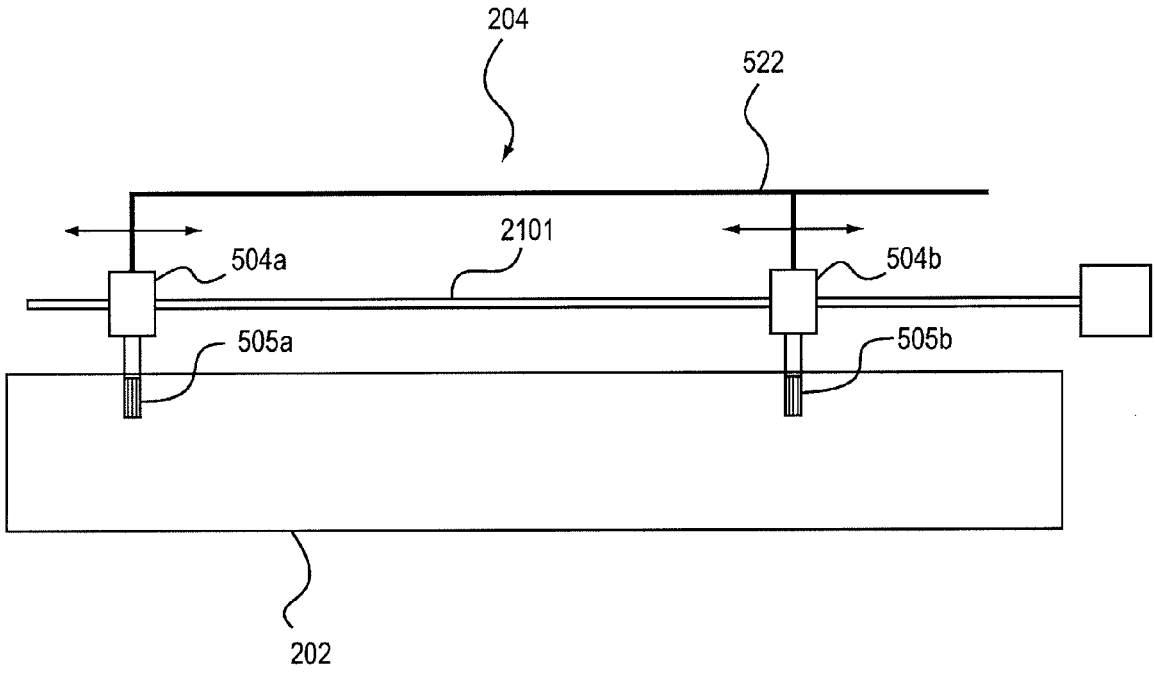
FIG. 13 is a layout view of the air ejecting portion against the fixing portion of a fourth embodiment of the present invention.
Figure 14:
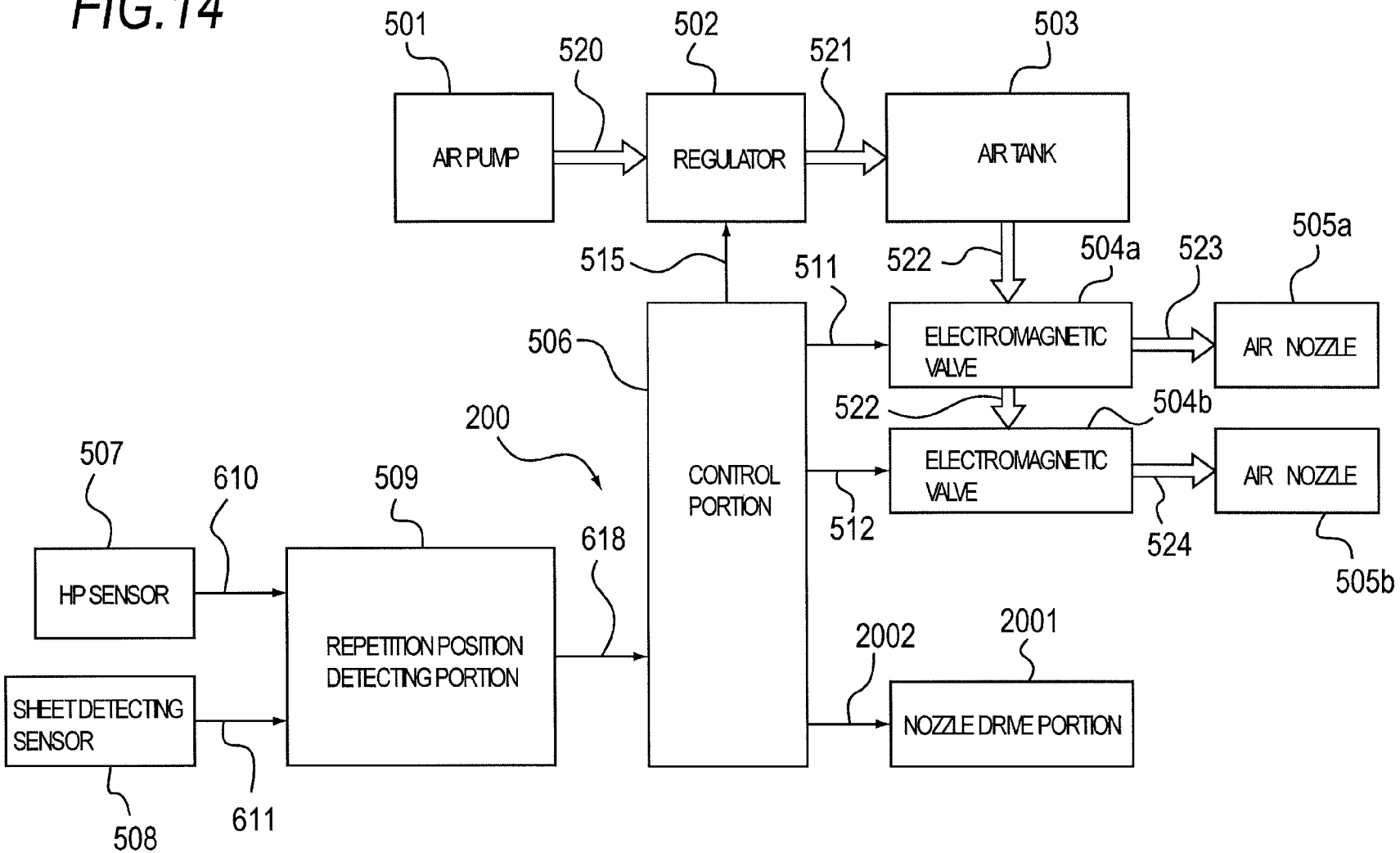
FIG. 14 is a block diagram which illustrates the general configuration of the air ejecting portion and the control unit thereof.

In the above description of the first to third embodiments, the case that the air is ejected selectively from the plurality of air ejection positions by selecting from the plurality of nozzles 505*a* to 505*d* is described. The fourth embodiment will be described in the case that the air is ejected selectively from the plurality of air ejection positions by moving a nozzle. Here, in the description of the fourth embodiment, the same numeral is given to the same structure of the first embodiment and the description thereof will be omitted. FIG. 13 is a layout view of an air ejecting portion 204A against the fixing portion 23. FIG. 14 is a block diagram illustrating the general configuration of the air ejecting portion 204A and the control unit 200 thereof.

The air ejecting portion 204A is provided with the air nozzles 505*a* and 505*b* as two nozzles arranged in parallel in the axis direction of the heat roller 202 so as to be capable of ejecting air toward the gap between the sheet top end and the circumference of the heat roller 202 of the fixing portion 23. Further, the air ejecting portion 204A is provided with the electromagnetic valves 504*a* and 504*b* as two control valves connected respectively to the air nozzles 505*a* and 505*b*. The electromagnetic valves 504*a* and 504*b* are connected with the connection pipe 522, so that the air having appropriate pressure is supplied to the electromagnetic valves 504*a* and 504*b* via the connection pipe 522. The air ejecting portion 204A includes a shaft 2101 arranged to pass over a frame (not illustrated) in the width direction being perpendicular to the sheet conveying direction and a nozzle drive portion 2001.

The electromagnetic valves 504*a* and 504*b* are supported by the shaft 2101 so that the air nozzles 505*a* and 505*b* are movable along with the electromagnetic valves 504*a* and 504*b* in the width direction being perpendicular to the sheet conveying direction. A groove (not illustrated) is formed at the shaft 2101 in the axis direction and a convex portion (not illustrated) to be hooked with the groove is respectively formed at the electromagnetic valves 504*a* and 504*b*, so that the air nozzles 505*a* and 505*b* are prevented from being rotated.

The nozzle drive portion 2001 drives the air nozzles 505*a* and 505*b* along with the electromagnetic valves 504*a* and 504*b* with a nozzle movement signal 2002 from the control portion 506. That is, the control portion 506 moves the air nozzles 505*a* and 505*b* in the width direction by outputting the nozzle movement signal 2002 to the nozzle drive portion 2001. Accordingly, the air ejection position can be changed.

Here, although the present invention is described based on the abovementioned embodiments, the present invention is not limited thereto. In the above description of the first to fourth embodiments, the case that the air ejection position is changed when the number of the same data reaches the predetermined number based on the plurality of position data or the prediction position data stored at the memory portion 606 is described. However, the present invention is not limited thereto. That is, it is also possible to change the air ejection position when the air is ejected by the predetermined number of times from the same air ejection position.

Further, in the description of the first to third embodiments, the case that four nozzles are provided to the air ejecting portion 204 is described. However, not limited to the number of pieces, it is possible to simply provide two or more nozzles to the air ejecting portion.

Further, in the description of the fourth embodiment, the case that two nozzles are provided to the air ejecting portion 204A is described. However, not limited to the number of pieces, it is possible to provide one or more nozzles.

Furthermore, in the description of the first embodiment, the case that the air ejection position detecting portion 604 obtains the position data 612 from the heat roller position detecting portion 601 at the timing of the ejection timing data 613 output by the ejection timing generating portion 603 is described. However, the present invention is not limited thereto. That is, it may also be the case that the air ejection position detecting portion 604 obtains the position data 612 from the heat roller position detecting portion 601 with a timing signal of a constant cycle of sheet arriving. In this case, it is preferable that the timing signal is generated at the control portion 506.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-126322, filed May 26, 2009, which is hereby incorporated by reference herein in its entirety.

What is claimed is:

1. An image forming apparatus comprising:

a transfer portion which transfers a toner image to a sheet;

a fixing portion which includes a fixing rotating member having a heat source and a pressing rotating member being pressure-contacted to the fixing rotating member and which fixes the toner image on the sheet at a nip portion of the fixing rotating member and the pressing rotating member;

an air ejecting portion configured to eject air toward a gap between the top end of the sheet having passed through the nip portion and the circumference of the fixing rotating member and which includes a plurality of air ejection positions arranged in the width direction being perpendicular to a sheet conveying direction;

a detecting portion which detects a rotational position of the fixing rotating member at the time when air is ejected by the air ejecting portion;

a memory portion which sequentially stores position data corresponding to the rotational position detected by the detecting portion; and a changing portion which changes an air ejection position of the air ejecting portion in a case that the number of position data that is the same as the lastly stored position data among a plurality of position data stored at the memory portion reaches a predetermined number.

2. The image forming apparatus according to claim 1, further comprising:

a sensor configured to detect that the fixing rotating member is rotated to a specific rotational position; and a position data output portion which sequentially outputs position data corresponding to a rotational position of the fixing rotating member having the specific rotational position detected by the sensor as a reference;

wherein the detecting portion obtains positional data to be stored at the memory portion from the position data output portion at the time when air is ejected from the air ejecting portion.

3. The image forming apparatus according to claim 1, wherein a control portion that controls the air ejecting portion so as to selectively eject air prohibits the changing portion from changing back to the previous air ejection position until a predetermined time passes in a case that the air ejection position of the air ejecting portion is changed, and wherein the control portion further halts sheet conveying to the fixing portion until the predetermined time passes when changing of the air ejection position is not allowed in a case that the number of position data being the same as the lastly stored position data among the plurality of position data stored at the memory portion reaches the predetermined number.

4. The image forming apparatus according to claim 1, wherein a control portion that controls the air ejecting portion so as to selectively eject air prohibits the changing portion from changing back to the previous air ejection position until a predetermined time passes in a case that the air ejection position of the air ejecting portion is changed, and wherein the control portion further enlarges an interval of sheet conveying to the fixing portion until the predetermined time passes when changing of the air ejection position is not allowed in a case that the number of position data being the same as the lastly stored position data among the plurality of position data stored at the memory portion reaches the predetermined number.

5. The image forming apparatus according to claim 1, wherein the air ejecting portion includes a plurality of nozzles which are arranged in parallel in the width direction and which are configured to eject air and a plurality of control valves which are connected respectively to the nozzles, and wherein the changing portion changes the air ejection position by changing the open/closed states of the control valves.

6. The image forming apparatus according to claim 1, wherein the air ejecting portion includes a nozzle that is movable in the width direction and is configured to eject air and a control valve connected to the nozzle, and wherein the changing portion changes the air ejection position by moving the nozzle in the width direction.

7. An image forming apparatus comprising:

a transfer portion which transfers a toner image to a sheet;

a fixing portion which includes a fixing rotating member having a heat source and a pressing rotating member being pressure-contacted to the fixing rotating member and which fixes the toner image on the sheet at a nip portion of the fixing rotating member and the pressing rotating member;

an air ejecting portion configured to eject air toward a gap between the top end of the sheet having passed through the nip portion and the circumference of the fixing rotating member and which includes a plurality of air ejection positions arranged in the width direction being perpendicular to a sheet conveying direction;

a predicting portion which predicts a rotational position of the fixing rotating member at the time when air is to be ejected by the air ejecting portion before the air ejecting portion performs air ejection;

a memory portion which sequentially stores prediction position data corresponding to the rotational position predicted by the predicting portion; and a changing portion which changes an air ejection position of the air ejecting portion in a case that the number of prediction position data that is the same as the lastly stored prediction position data among a plurality of prediction position data stored at the memory portion reaches a predetermined number.

8. The image forming apparatus according to claim 7, further comprising:

a sensor configured to detect that the fixing rotating member is rotated to a specific rotational position;

a position data output portion which sequentially outputs position data corresponding to a rotational position of the fixing rotating member having the specific rotational position detected by the sensor as a reference; and a sheet detecting portion which is arranged upstream in the sheet conveying direction of the fixing portion and which detects the sheet to be conveyed, wherein the predicting portion obtains prediction position data to be stored at the memory portion based on the position data from the position data output portion obtained at a sheet detection timing of the sheet detecting portion.

9. The image forming apparatus according to claim 7, wherein a control portion that controls the air ejecting portion so as to selectively eject air prohibits the changing portion from changing back to the previous air ejection position until a predetermined time passes in a case that the air ejection position of the air ejecting portion is changed, and wherein the control portion further halts sheet conveying to the fixing portion until the predetermined time passes when changing of the air ejection position is not allowed in a case that the number of prediction position data that is the same as the lastly stored prediction position data among the plurality of prediction position data stored at the memory portion reaches the predetermined number.

10. The image forming apparatus according to claim 7, wherein a control portion that controls the air ejecting portion so as to selectively eject air prohibits the changing portion from changing back to the previous air ejection position until a predetermined time passes in a case that the air ejection position of the air ejecting portion is changed, and wherein the control portion further enlarges an interval of sheet conveying to the fixing portion until the predetermined time passes when changing of the air ejection position is not allowed in a case that the number of prediction position data that is the same as the lastly stored prediction position data among the plurality of prediction position data stored at the memory portion reaches the predetermined number.

11. An image forming apparatus comprising:

a transfer portion which transfers a toner image to a sheet;

a fixing portion which includes a fixing rotating member having a heat source and a pressing rotating member being pressure-contacted to the fixing rotating member and which fixes the toner image on the sheet at a nip portion of the fixing rotating member and the pressing rotating member;

an air ejecting portion which is capable of ejecting air toward a gap between the top end of the sheet having passed through the nip portion and the circumference of the fixing rotating member and which includes a plurality of air ejection positions arranged in the width direction being perpendicular to a sheet conveying direction;

a detecting portion which detects a rotational position of the fixing rotating member at the time when air is ejected by the air ejecting portion; and a memory portion which sequentially stores position data corresponding to the rotational position detected by the detecting portion, wherein a control portion that controls the air ejecting portion so as to selectively eject air halts sheet conveying to the fixing portion until a predetermined time passes in a case that the number of position data that is the same as the lastly stored position data among the plurality of position data stored at the memory portion reaches a predetermined number.

* * * * *